US006735069B2

(12) United States Patent
Ehara

(10) Patent No.: US 6,735,069 B2
(45) Date of Patent: May 11, 2004

(54) SOLENOID DRIVER CIRCUIT

(75) Inventor: Takayuki Ehara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 137 days.

(21) Appl. No.: 10/076,599

(22) Filed: Feb. 19, 2002

(65) Prior Publication Data

US 2002/0114120 A1 Aug. 22, 2002

(30) Foreign Application Priority Data

Feb. 19, 2001 (JP) ..... P2001-042071

(51) Int. Cl.[7] ..... H01H 9/00
(52) U.S. Cl. ..... 361/160; 361/159; 361/166
(58) Field of Search ..... 361/160, 159, 361/166, 152, 170; 307/64, 85, 86

(56) References Cited

U.S. PATENT DOCUMENTS 4,445,238 A * 5/1984 Maxhimer ..... 4/508
6,538,345 B1 * 3/2003 Maller ..... 307/86

FOREIGN PATENT DOCUMENTS

| | | |
|---|---|---|
| CA | 2211667 | 5/1999 |
| EP | 0 779 631 A2 | 6/1997 |
| JP | 7-290895 | 11/1995 |
| JP | 8-254280 | 10/1996 |

* cited by examiner

*Primary Examiner*—Anthony Dinkins
(74) *Attorney, Agent, or Firm*—Morgan, Lewis & Bockius LLP

(57) ABSTRACT

A solenoid driver circuit includes an idling control portion for applying a very low voltage less than an activation threshold value to a solenoid from a switching circuit; a computing portion for computing the resistance value of the solenoid with the current value flowing through the solenoid and the applied voltage; and a constant-current control portion for maintaining the current flowing through the solenoid constant regardless of the temperature of the winding of the solenoid by controlling the output voltage from the switching circuit according to the resistance value. When the solenoid is activated, the supplied current is controlled constant irrespective of the temperature of the winding of the solenoid.

1 Claim, 2 Drawing Sheets

SOLENOID DRIVER CIRCUIT

BACKGROUND OF THE INVENTION

1. Field of the Invention

This invention relates to a solenoid driver circuit and, more particularly, to a solenoid driver circuit designed to correct variations in the characteristics of a solenoid due to temperature.

2. Description of the Related Art

The value of the electrical resistance of a solenoid varies in proportion to the temperature of the winding. If the winding temperature rises in accordance with the energization time and the energization current value, the electrical resistance increases. When the electrical resistance increases, the current flowing through the solenoid drops even if the same voltage is applied. As a result, the attracting force decreases, resulting in a decrease in the operating speed of the actuator. Where the temperature is lower than the specified temperature, overcurrent will flow through the solenoid, and settling to the target current value will be delayed in the same way as in cases of high temperatures. Depending on the mode of use of the solenoid actuator, variations in the attracting force due to the temperature of the winding may present no problems. However, where more accurate control of attracting force is necessary, variations in the attracting force pose problems.

FIG. 3 shows the current through a solenoid in a cutting machine for cut sheet that makes cut lettering by driving a cutting head up and down by a solenoid actuator. A voltage is supplied from a driver circuit in a given pattern, whereby the solenoid is activated. At this time, the current value varies according to the temperature of the solenoid. As the temperature rises, the current value drops and lowers the landing speed of the cutting head. This may make the cutting depth uneven when the head lands and at the beginning of the cutting. Furthermore, the deviation from the voltage necessary to match the target current value becomes greater than a prescribed value and increases the amount of feedback control. Time differences ($S_1$, $S_2$, and $S_3$) occur until the current is controlled to a certain current. If one tries to cover the used temperature range, he or she must wait until $S_{max}$. This leads to a decrease in the cutting speed.

SUMMARY OF THE INVENTION

Accordingly, a technical problem to be solved occurs to eliminate variations in the operating characteristics due to the temperature of the winding of a solenoid. The present invention is intended to solve the foregoing problem.

This invention is proposed to achieve the above-described object, and provides a solenoid driver circuit including: control means for applying a voltage less than an activation threshold value to a solenoid from a power supply when the solenoid is deactivated; means for detecting a current value when the voltage is applied; means for computing a resistance value of the solenoid with the applied voltage and the detected current value; and constant-current control means for maintaining the current value constant during operation by controlling a solenoid driving voltage according to the calculated resistance value.

DETAILED DESCRIPTION OF THE PREFERRED EMBODIMENTS

Figure 1:
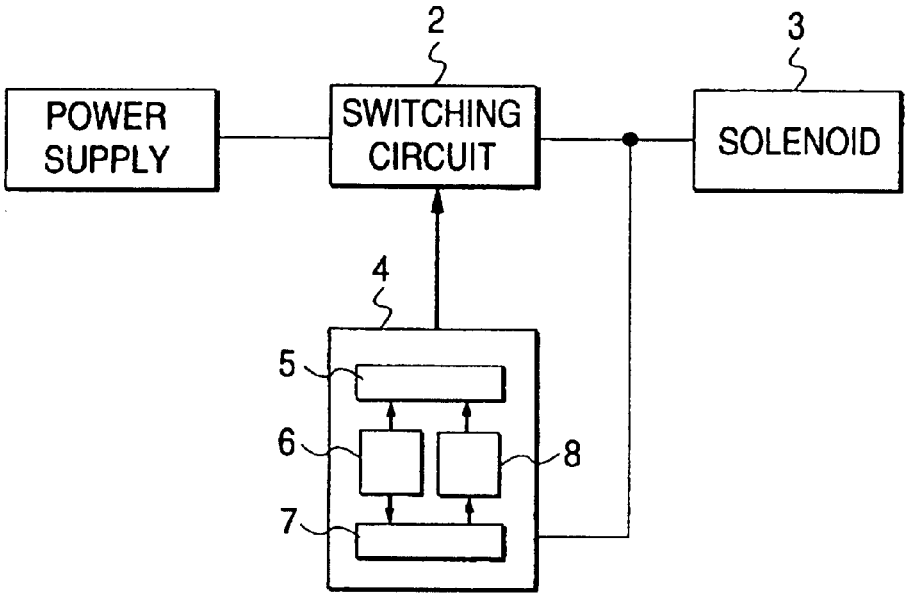
FIG. 1 is a block diagram of a solenoid driver circuit of the present invention.

One mode for carrying out this invention is hereinafter described by referring to the drawings. In FIG. 1, indicated by 2 is an inverter-controlled switching circuit. Indicated by 3 is a solenoid. Indicated by 4 is a control portion. The control portion 4 has an ordinary duty ratio control portion 5 for varying the DC output voltage by controlling the on/off duty ratio of a switching element in the switching circuit 2. In addition, the control portion 4 includes: an idling control portion for applying a very low voltage less than an activation threshold value to the solenoid 3 by delivering a control signal to the duty ratio control portion 5; a computing portion 7 for computing the resistance value of the solenoid with the current value flowing through the solenoid 3 and the applied voltage; and a constant-current control portion 8 for maintaining the current value flowing through the solenoid 3 constant by producing a control signal to the duty ratio control portion 5.

When the solenoid 3 is deactivated, the output signal from the idling control portion 6 causes the duty ratio control portion 5 to control the duty ratio of the switching circuit 2 at a low level. A very weak DC voltage less than the activation threshold value is applied from the switching circuit 2 to the solenoid 3. When the solenoid 3 is started, the computing portion 7 detects the current value flowing through the solenoid 3 during idling, and computes the resistance value from the detected current value. The constant-current control portion 8 controls the duty ratio control portion 5 so that the current flowing through the solenoid during operation of the solenoid becomes a prescribed value according to the computed resistance value, and the output voltage of the switching circuit 2 is controlled.

Figure 2:
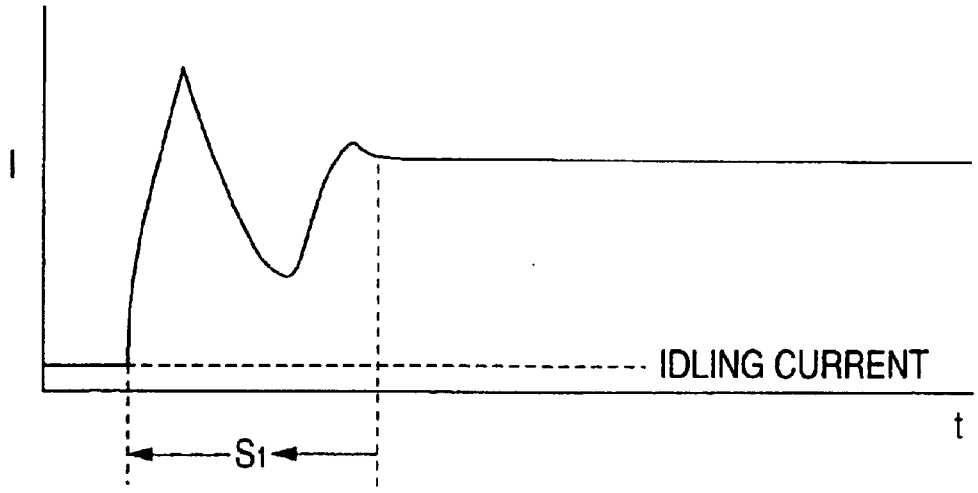
FIG. 2 is a graph of a solenoid driving current by the solenoid driver circuit of the invention.
Figure 3:
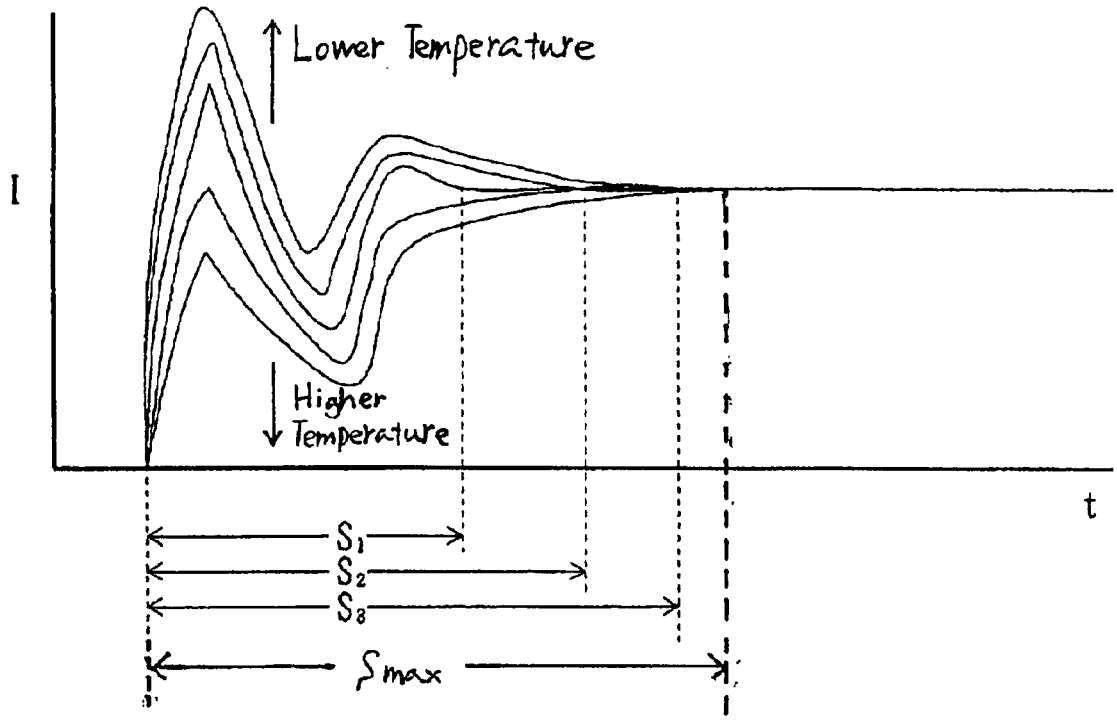
FIG. 3 is a graph of the solenoid driving current illustrating the temperature characteristics of a solenoid.

In particular, when the temperature of winding of the solenoid rises and the resistance value increases, the output voltage from the switching circuit 2 increases automatically, and the current value is set to the prescribed value. accordingly, variations in the current value due to variations in the resistance value of the solenoid are automatically corrected. This compensates for variations in the operating characteristics due to the temperature of the winding of the solenoid shown in FIG. 3. Consequently, the operating characteristics can be kept constant within the operable temperature range in spite of temperature variations as shown in FIG. 2. Then, feedback control is provided to match the target current value. It is possible to quickly bring the current into the target current value because control is provided with a duty ratio set by taking account of the temperature characteristics.

It is to be noted that this invention is not restricted to the embodiment described above. Various changes and modifications are possible within the technical scope of this invention. Of course, this invention covers these modifications.

As described above, a solenoid driver circuit of the present invention reads variations in the resistance value of a solenoid and controls a power supply such that the supplied current during operation of the solenoid is in a certain pattern. Therefore, the operating speed of a solenoid actuator is controlled constant irrespective of the temperature of the winding of the solenoid, and the operation stabilizes. Furthermore, the settling time to the target current value is shortened. This contributes to increase in the operating speed.

What is claimed is:

1. A solenoid driver circuit comprising:

a control portion for applying a voltage less than an activation threshold value to a solenoid from a power supply when the solenoid is deactivated;

a detecting portion for detecting a current value when the voltage is applied;

a computing portion for computing a resistance value of the solenoid with the applied voltage and the detected current value; and a constant-current control portion for maintaining an operation current value constant during operation by controlling a solenoid driving voltage according to the calculated resistance value.

* * * * *